United States Patent [19]

DuBois et al.

[11] Patent Number: 4,577,608

[45] Date of Patent: Mar. 25, 1986

[54] CARBURETION SYSTEM INCLUDING AN ADJUSTABLE THROTTLE LINKAGE

[75] Inventors: Chester G. DuBois, Zion; John D. Flaig, Libertyville, both of Ill.

[73] Assignee: Outboard Marine Corporation, Waukega, Ill.

[21] Appl. No.: 635,240

[22] Filed: Jul. 27, 1984

[51] Int. Cl.[4] ..... F02B 13/00

[52] U.S. Cl. ..... 123/583; 123/336; 261/50 A; 261/65

[58] Field of Search ..... 123/583, 580, 336; 261/50 A, 65

[56] References Cited

U.S. PATENT DOCUMENTS

| | | | |
|---|---|---|---|
| Re. 20,651 | 2/1938 | VanderPoel | 123/336 |
| 1,935,260 | 11/1933 | Broge | 261/65 UX |
| 2,085,818 | 7/1937 | Messinger et al. | 123/583 |
| 2,420,925 | 5/1947 | Wirth | 123/583 |
| 2,681,213 | 6/1954 | Gordon | 123/583 |
| 2,761,437 | 9/1956 | Stolte | 123/583 |
| 2,868,520 | 1/1959 | Olson et al. | 123/580 |
| 2,986,131 | 5/1961 | Larsen | 123/336 |
| 2,989,333 | 6/1961 | Fox | 74/522 |
| 3,205,879 | 9/1965 | Seggern et al. | 123/583 |
| 3,943,904 | 3/1976 | Bryne | 123/336 |
| 3,953,549 | 4/1976 | Moulds | 261/50 A |
| 4,016,842 | 4/1977 | Kittler | 74/513 |
| 4,117,809 | 10/1978 | Kittler | 74/513 |
| 4,384,559 | 5/1983 | Tchany et al. | 123/336 |

FOREIGN PATENT DOCUMENTS

| | | | |
|---|---|---|---|
| 97032 | 6/1982 | Japan | 123/583 |

*Primary Examiner*—E. Rollins Cross

*Attorney, Agent, or Firm*—Michael, Best & Friedrich

[57] ABSTRACT

A throttle linkage assembly comprising a throttle shaft rotatable about a throttle shaft axis between an idle position and a wide open throttle position, a throttle plate fixed on the throttle shaft, a driven lever pivotable about the throttle shaft axis between various angles relative to the throttle plate, an adjustment lever assembly for fixing the driven lever at a selected angle relative to the throttle plate, and a timing plate operable on the driven lever for rotating the throttle shaft from the idle position to the wide open throttle position.

9 Claims, 2 Drawing Figures

CARBURETION SYSTEM INCLUDING AN ADJUSTABLE THROTTLE LINKAGE

BACKGROUND OF THE INVENTION

This invention relates to carburetion systems provided for internal combustion engines and, more particularly, to throttle linkages included in such carburetion systems, and, even more particularly, to means for adjusting such throttle linkages.

Attention is directed to the following U.S. patents which disclose carburetion systems.

| Patentee | U.S. Pat. No. | Issued |
|---|---|---|
| Stolte | 2,761,437 | Sept. 4, 1956 |
| Moulds | 3,953,549 | April 27, 1976 |
| Kittler | 4,016,842 | April 12, 1977 |
| Kittler | 4,117,809 | Oct. 3, 1978 |

Attention is also directed to U.S. Pat. No. 2,989,333, issued June 20, 1961, to Fox, which discloses adjustable means for a door latch operator.

SUMMARY OF THE INVENTION

This invention provides a throttle linkage assembly comprising a throttle shaft rotatable about a throttle shaft axis between an idle position and a wide open throttle position. The throttle linkage assembly also includes a throttle plate fixed on the throttle shaft, a driven lever pivotable about the throttle shaft axis between various angles relative to the throttle plate, and means for fixing the driven lever at a selected angle relative to the throttle plate. The linkage assembly also includes means operable on the driven lever for rotating the throttle shaft from the idle position to the wide open throttle position.

In one embodiment, the means for fixing the driven lever comprises means for biasing the driven lever, when the throttle shaft is in the idle position, toward the means for rotating the throttle shaft, an adjustment lever fixedly connected to the throttle shaft adjacent the driven lever, and means for releasably securing the driven lever to the adjustment lever.

In one embodiment, the biasing means can be operable between the adjustment lever and the driven lever.

This invention also provides a carburetion system for an internal combustion engine, the carburetion system comprising a first carburetor including a first throttle shaft rotatable about a first throttle shaft axis between an idle position and a wide open throttle position, and a throttle plate fixed on the first throttle shaft. The carburetion system also includes a second carburetor including a second throttle shaft generally parallel to and spaced from the first throttle shaft, and a driving lever fixedly connected to the second throttle shaft. The carburetion system also includes a first throttle shaft driven lever pivotable about the first throttle shaft axis between various angles relative to the first throttle shaft plate, a link pivotally connected to the second throttle shaft driving lever and to the first throttle shaft driven lever, and means for fixing the first throttle shaft driven lever to the first throttle shaft at a selected angle relative to the first throttle shaft plate. The means for fixing the first throttle shaft driven lever comprises means for biasing the first throttle shaft driven lever toward the link when the first throttle shaft is in the idle position, an adjustment lever fixedly connected to the first throttle shaft adjacent the first throttle shaft driven lever, and means for releasably securing the first throttle shaft driven lever to the first throttle shaft adjustment lever.

In one embodiment, the second throttle shaft is rotatable about a second throttle shaft axis between an idle position and a wide open throttle position, and the second carburetor further includes a throttle plate fixed on the second throttle shaft. Further, the carburetion system includes a drive lever adjacent the second throttle shaft driving lever and pivotable about the second throttle shaft axis between various angles relative to the second throttle shaft plate, and means for fixing the second throttle shaft driven lever to the second throttle shaft at a selected angle relative to the second throttle shaft plate, the means comprising means for biasing the second throttle shaft driven lever towards the link when the second throttle shaft is in the idle position, and means for releasably securing the second throttle shaft driven lever to the second throttle shaft driving lever. Further, the carburetion system also includes means operable on the second throttle shaft driven lever for rotating the second throttle shaft from the idle position to the wide open throttle position.

In one embodiment, the means for rotating the second throttle shaft comprises a plate including a camming surface, and a roller rotatably connected to the second throttle shaft driven lever and movable by the camming surface.

One of the principal features of the invention is the provision of a carburetion system including throttle linkage including means for adjusting the throttle linkage to eliminate any play present in the throttle linkage.

Another of the principal features of the invention is the provision of such means for adjusting throttle linkage which means is applicable to adjusting the linkage between multiple carburetors.

Another of the principal features of the invention is the provision of such adjustable throttle linkage which can be used with a throttle timing plate.

Other features and advantages of embodiments of the invention will become apparent on reviewing the following drawings, the detailed description and the appended claims.

Figure 1:
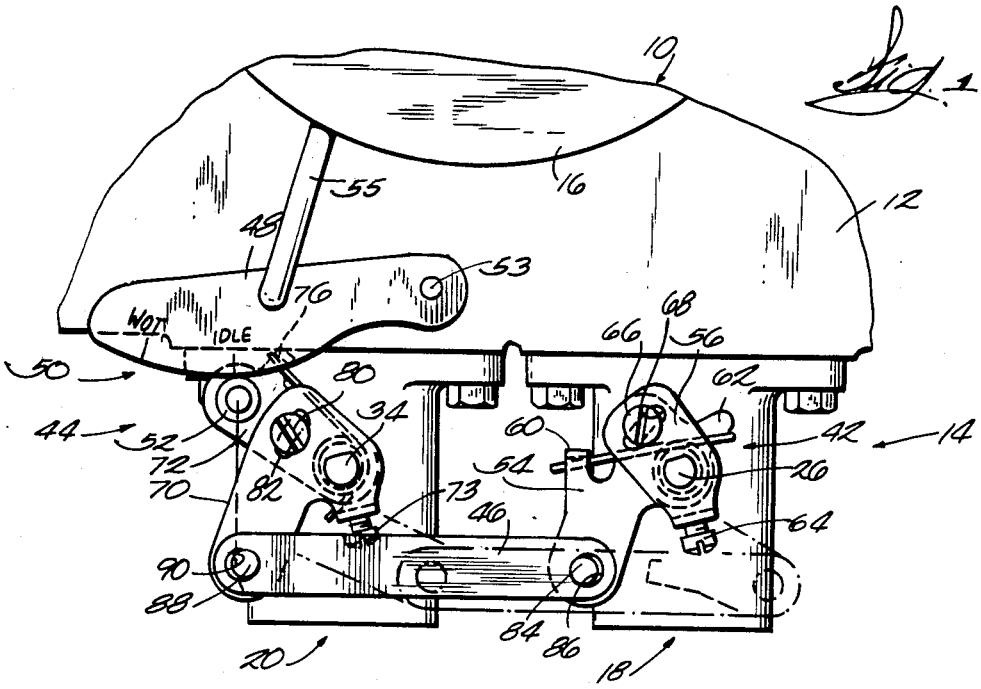
FIG. 1 is a partial schematic top view of a internal combustion engine including a carburetion system which embodies various of the features of the invention.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

Illustrated schematically in FIG. 1 is an internal combustion engine 10 including a crankcase, a manifold 12 attached to the crankcase, and a carburetion system 14 for providing a fuel and air mixture to the engine 10.

Extending from the crankcase is a crankshaft (not shown) connected to a flywheel 16.

Although the invention described herein is applicable to single carburetor systems, as well as to systems including more than two carburetors, in this embodiment, the carburetion system comprises a first side draft carburetor 18, a second side draft carburetor 20, and linkage means for controlling the fuel-air flow through the carburetors 18 and 20. In other embodiments, top draft carburetors can be used.

Figure 2:
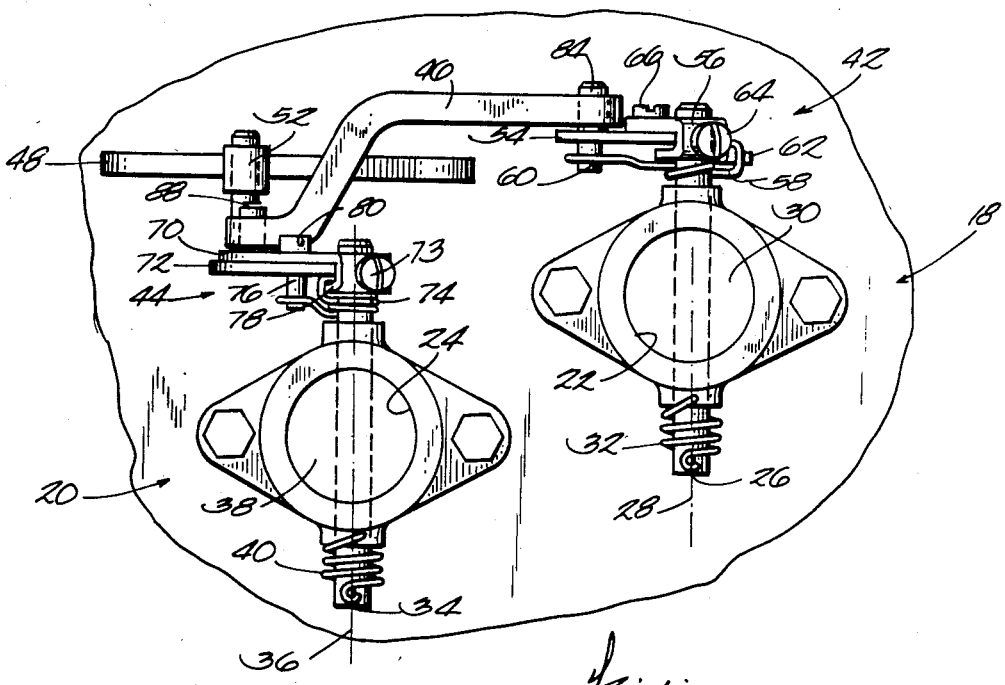
FIG. 2 is a side view of the carburetion system illustrated in FIG. 1.

The carburetors 18 and 20 include carburetor bodies including throttle bores or venturis 22 and 24, respectively. The first carburetor 18 also includes a first throttle shaft 26 mounted in the first carburetor body and rotatable about a first throttle shaft axis 28 between an idle position and a wide open throttle position. A first throttle plate 30 (shown only in FIG. 2) is fixed on the first throttle shaft 26 and controls the amount of fuel and air which passes through the first venturi 22. Also provided is a first torsion-type throttle spring 32 concentric with the end of the first throttle shaft 26 and operable between the first throttle shaft 26 and the first carburetor body for returning the first throttle shaft 26 from the wide open throttle position to the idle position (clockwise in FIG. 1).

The second carburetor 20 includes a second throttle shaft 34 which is parallel to and spaced from the first throttle shaft 26. The second throttle shaft 34 is mounted in the second carburetor body and is rotatable about a second throttle shaft axis 36 between an idle position and a wide open throttle position. A second throttle plate 38 (shown only in FIG. 2) is fixed on the second throttle shaft 34 and controls the amount of fuel and air which passes through the second venturi 24. Also provided, for returning the second throttle shaft 34 from the wide open throttle position to the idle position (clockwise in FIG. 1), is a second torsion-type throttle spring 40 concentric with the end of the second throttle shaft 34 and operable between the second throttle shaft 34 and the second carburetor body.

The linkage means for controlling the fuel and air flow through the carburetors 18 and 20 comprises a first throttle shaft linkage 42 connected to the first throttle shaft 26, a second throttle shaft linkage 44 connected to the second throttle shaft 34, means operable on the second throttle shaft linkage 44 for rotating the second throttle shaft 34 from the idle position to the wide open throttle position, and a link 46 pivotally connected to the second throttle shaft linkage 44 and to the first throttle shaft linkage 42 for simultaneously rotating the first throttle shaft linkage 42 when the second throttle shaft linkage 44 is rotated.

While various suitable means could be employed, in the preferred embodiment, the means operable on the second throttle shaft linkage 44 comprises a timing plate or cam 48 including a camming surface 50, and a roller 52 rotatably connected to the second throttle shaft linkage 44 and movable by the camming surface 50. The plate 48 is pivotable about pivot 53, and pivotal movement of the plate 48 is controlled by a link 55. The link 55 is operatively connected to a spark timing device (not shown) so that pivotal movement of the plate 48 controls fuel and air flow through the carburetors 18 and 20 (as will be described below) relative to the spark timing. Alternatively, the timing plate 48 could be fixed to the timer plate of the engine 10 for pivotal rotation therewith. An example of such a timing plate is described in U.S. Pat. No. 2,906,251, to Soder, which is incorporated herein by reference. The timing plate 48 is marked to indicate the idle and wide open throttle positions. As will also be described below, the positioning of the roller 52 relative to the camming surface 50 can be accurately set by aligning the roller 52 with the marked idle position.

The means operable on the second throttle shaft linkage 44 causes rotation of the second throttle shaft linkage 44 in the counterclockwise direction, and this causes rotation of the second throttle shaft 34 from the idle position to the wide open throttle position. Rotation of the second throttle shaft linkage 44 also moves the link 46, thereby causing rotation of the first throttle shaft linkage 42 in the counterclockwise direction. Rotation of the first throttle shaft linkage 42 causes rotation of the first throttle shaft 26. The link 46 therefore is operable on the first throttle shaft linkage 42 to cause rotation of the first throttle shaft 26 from the idle position to the wide open throttle position. The above described rotation of the first and second throttle shaft linkages 42 and 44 and the associated movement of the link 46 are illustrated in phantom in FIG. 1.

In any means for rotating a throttle shaft, some play is present between the means for rotating the shaft and the shaft. This is particularly true when two or more carburetors are connected together, since the distance between the carburetors can vary. In some cases, this play may be caused by some freedom of movement in a pivotal connection, such as the pivotal connection of the link 46 to the first throttle shaft linkage 42, or the play may be caused by space between a member and another member which bears against that member, such as in the case of the timing plate 48 and roller 52. Play can also be introduced into a linkage in other ways not herein described. This invention provides each of the first throttle shaft linkage 42 and the second throttle shaft linkage 44 with means for eliminating play which may exist in the linkage means.

More particularly, the first throttle shaft linkage 42 comprises a first throttle shaft driven lever 54 pivotable about the first throttle axis 28 between various angles relative to the first throttle shaft plate 30, and means for fixing the first throttle shaft driven lever 54 to the first throttle shaft 26 at a selected angle relative to the first throttle shaft plate 30.

The means for fixing the first throttle shaft driven lever 54 to the first throttle shaft 26 comprises means for biasing the first throttle shaft driven lever 54 toward the means for rotating the first throttle shaft driven lever 54, i.e., the link 46, when the first throttle shaft 26 is in the idle position, a first throttle shaft adjustment lever 56 fixedly connected to the first throttle shaft 26 adjacent the first throttle shaft driven lever 54, and means for releasably securing the first throttle shaft driven lever 54 to the first throttle shaft adjustment lever 56.

In the embodiment disclosed, the means for biasing the first throttle shaft driven lever 54 toward the link 46 comprises a torsion-type spring 58 coiled around the first throttle shaft 26 and having one end forced against an abutment 60 on the driven lever 54 and an opposite end forced against an abutment 62 on the adjustment lever 56. The spring 58 biases the driven lever 54 clockwise in FIG. 1.

When the first throttle shaft linkage 42 is adjusted, as described hereinafter, the first throttle shaft 26 should remain in the idle position while the biasing spring 58 operates against the first throttle shaft driven lever 54. In order to prevent the biasing spring 58 from overcoming the first throttle shaft return spring 32 and dislodging the first throttle shaft 26 from the idle position, the biasing spring 58 should be weaker than the first throttle shaft return spring 32.

In the illustrated embodiment, the first throttle shaft adjustment lever 56 is fixedly attached to the first throttle shaft 26 by a screw 64.

Although other constructions can be employed, in the illustrated embodiment, the means for releasably securing the first throttle shaft driven lever 54 to the first throttle shaft adjustment lever 56 comprises a screw 66 threadedly engaged in a threaded opening in the first throttle shaft driven lever 54. The screw 66 extends through an aperture 68 which is in the first throttle shaft adjustment lever 56 and which is wider than the diameter of the screw 66 to permit movement of the first throttle shaft driven lever 54 relative to the first throttle shaft adjustment lever 56 when the screw 66 is loosened. This permits adjustment of the angle formed between the first throttle shaft driven lever 54 and the first throttle shaft plate 30.

The second throttle shaft linkage 44 includes a second throttle shaft driving lever 70 fixedly connected to the second throttle shaft 34 for moving the link 46 and for serving as a second adjustment lever, and a second throttle shaft driven lever 72 which has the roller 52 mounted thereon, and which is pivotally mounted on the second throttle shaft 34 adjacent the second throttle shaft driving lever 70. The driving lever 70 is fixedly connected to the second throttle shaft 34 by a screw 73. The driven lever 72 is pivotable about the second throttle shaft axis 36 between various angles relative to the second throttle shaft plate 38. The second throttle shaft linkage 44 also includes means for fixing the second throttle shaft driven lever 72 to the second throttle shaft 34 at a selected angle relative to the second throttle shaft plate 38.

While various suitable means for fixing the second throttle shaft driven lever 72 to the second throttle shaft 34 can be used, in the illustrated construction, the means includes means for biasing the second throttle shaft driven lever 72 toward the timing plate 48, and means for releasably securing the second throttle shaft driven lever 72 to the second throttle shaft driving lever 70.

While other constructions can be employed in other embodiments, in this embodiment the biasing means is a torsion-type spring 74 which coils around the second throttle shaft 34 and which includes one end forced against an abutment 76 on the second throttle shaft driven lever 72 and an opposite end forced against an abutment 78 on the second throttle shaft driving lever 70. The spring 74 biases the driven lever 72 clockwise in FIG. 1.

When the second throttle shaft linkage 44 is adjusted, as hereinafter described, the second throttle shaft 34 should remain in the idle position while the biasing spring 74 operates against the second throttle shaft driven lever 72. The biasing spring 74 should be weak enough so that it does not dislodge the second throttle shaft 34 from the idle position by overcoming the forces biasing the second throttle shaft 34 toward the idle position.

In the illustrated embodiment, the means for releasably securing the second throttle shaft driven lever 72 to the second throttle shaft driving lever 70 comprises a screw 80 received in a threaded opening in the second throttle shaft driven lever 72. The screw 80 is received in an aperture 82 which is in the second throttle shaft driving lever 70 and which is wider than the diameter of the screw 80 to permit adjustment of the relative position between the second throttle shaft driven lever 72 and the second throttle shaft driving lever 70 and adjustment of the angle between the second throttle shaft driven lever 72 and the second throttle shaft plate 38.

As indicated previously, the link 46 is pivotally connected to the second throttle shaft driving lever 70 and to the first throttle shaft driven lever 54 in such a way that some play is permitted between the link 46 and each of the respective levers 54 and 70. In the illustrated embodiment, the link 46 is connected to the respective levers 54 and 70 by means of a pin 84 extending from the first throttle shaft driven lever 54 and being received in an opening 86 in the right end of the link 46, and a pin 88 extending from the second throttle shaft driving lever 70 and being received in an opening 90 in the left end of the link 46. The size of the openings 86 and 90 in the link 46 has been exaggerated for purposes of illustrating the freedom of movement between the link 46 and the pins 84 and 88.

While other constructions can be employed in other embodiments, in this embodiment, the link 46 includes an offset for purposes of permitting the second carburetor 20 to be located downwardly from the first carburetor 18. The offset, therefore, permits connection between these offset carburetors 18 and 20.

The linkage means for the first and second carburetors 18 and 20 is adjusted to eliminate any play present therein in the following manner. The first throttle shaft plate 30 and the second throttle shaft plate 38 are positioned in the fully closed or idle position. The first adjustment screw 66 is loosened, and the spring 58 causes the first throttle shaft driven lever 54 to rotate so that the pin 84 on the first throttle shaft driven lever 54 is forced to the left side of the opening 86 in the link 46, and this in turn forces the right side of the opening 90 in the link 46 against the pin 88 extending from the second throttle shaft driving lever 70. Since the link 46 and pins 84 and 88 will always bear against one another in this manner during operation of the linkage means, any play present between these parts will now have been eliminated from the throttle linkage. After the pin 84 has moved into abutment with the left side of the opening 86 and the pin 88 has moved into abutment with the right side of the opening 90, the first adjustment screw 66 is then tightened.

Next, the second adjustment screw 80 is loosened. The spring 74 then eliminates any undesirable spacing between the roller 52 and the cam surface 50 of the timing plate 48, and the roller 52 is positioned so as to be adjacent the idle position on the timing plate 48. The adjustment screw 80 is then tightened to fix the position of the second throttle shaft driven lever 72 relative to the second throttle shaft driving lever 70.

Various features of the invention are set forth in the following claims.

We claim:

1. A throttle linkage assembly comprising a throttle shaft rotatable about a throttle shaft axis between an idle position and a wide open throttle position, a throttle plate fixed on said throttle shaft, a driven lever pivotable about said throttle shaft axis between various angles relative to said throttle plate, and means for fixing said driven lever at a selected angle relative to said throttle plate an adjustment lever fixedly connected to said throttle adjacent said driven lever, and means for releasably securing said driven lever to said adjustment lever.

2. A throttle linkage assembly comprising a throttle shaft rotatable about a throttle shaft axis between an idle position and a wide open throttle position, a throttle plate fixed on said throttle shaft, a driven lever pivotable about said throttle shaft axis between various angles relative to said throttle plate, means operable on said driven lever for rotating said throttle shaft from said idle position to said wide open throttle position, and means for fixing said driven lever at a selected angle relative to said throttle plate, said means comprising means for biasing said driven lever, when said throttle shaft is in said idle position, toward said means for rotating said throttle shaft, an adjustment lever fixedly connected to said throttle shaft adjacent said driven lever, and means for releasably securing said driven lever to said adjustment lever.

3. A throttle linkage assembly in accordance with claim 2 wherein said biasing means is operable between said adjustment lever and said driven lever.

4. A throttle linkage assembly for adjusting the linkage between two adjacent carburetors, said assembly comprising a first throttle shaft rotatable about a first throttle shaft axis, a throttle plate fixed on said first throttle shaft, a second throttle shaft generally parallel to and spaced from said first throttle shaft and rotatable about a second throttle shaft axis, a second throttle shaft driving lever fixedly connected to said second throttle shaft, a first throttle shaft driven lever pivotable about said first throttle shaft axis between various angles relative to said first throttle shaft plate, means for fixing said first throttle shaft driven lever to said first throttle shaft at a selected angle relative to said first throttle shaft plate, and a link pivotally connected to said second throttle shaft driving lever and to said first throttle shaft driven lever.

5. A throttle linkage assembly in accordance with claim 4 wherein said second throttle shaft is rotatable between an idle position and a wide open throttle position, and wherein said assembly further includes a throttle plate fixed on said second throttle shaft, a second throttle shaft driven lever adjacent said second throttle shaft driving lever and pivotable about said second throttle shaft axis between various angles relative to said second throttle shaft plate, means for fixing said second throttle shaft driven lever to said second throttle shaft at a selected angle relative to said second throttle shaft plate, and means operable on said second throttle shaft driven lever for rotating said second throttle shaft from said idle position to said wide open throttle position.

6. A throttle linkage assembly in accordance with claim 5 wherein said means for rotating said second throttle shaft comprises a plate including a camming surface, and a roller rotatably connected to said second throttle shaft driven lever and movable by said camming surface.

7. A carburetion system for an internal combustion engine, said carburetion system comprising a first carburetor including a first throttle shaft rotatable about a first throttle shaft axis between an idle position and a wide open throttle position, and a throttle plate fixed on said first throttle shaft, a second carburetor including a second throttle shaft generally parallel to and spaced from said first throttle shaft, and a second throttle shaft driving lever fixedly connected to said second throttle shaft, a first throttle shaft driven lever pivotable about said first throttle shaft axis between various angles relative to said first throttle shaft plate, a link pivotally connected to said second throttle shaft driving lever and to said first throttle shaft driven lever, and means for fixing said first throttle shaft driven lever to said first throttle shaft at a selected angle relative to said first throttle shaft plate, said means comprising means for biasing said first throttel shaft driven lever towards said link when said first throttle shaft is in said idle position, an adjustment lever fixedly connected to said first throttle shaft adjacent said first throttle shaft driven lever, and means for releasably securing said first throttle shaft driven lever to said first throttle shaft adjustment lever.

8. A carburetion system in accordance with claim 7 wherein said second throttle shaft is rotatable between an idle position and a wide open throttle position and about a second throttle shaft axis, wherein said second carburetor further includes a throttle plate fixed on said second throttle shaft, and wherein said carburetion system further includes a second throttle shaft driven lever adjacent said second throttle shaft driving lever and pivotable about said second throttle shaft axis between various angles relative to said second throttle shaft plate, means for fixing said second throttle shaft driven lever to said second throttle shaft at a selected angle relative to said second throttle shaft plate, said means comprising means for biasing said second throttle shaft driven lever towards said link when said second throttle shaft is in said idle position, and means for releasably securing said second throttle shaft driven lever to said second throttle shaft driving lever, and means operable on said second throttle shaft driven lever for rotating said second throttle shaft from said idle position to said wide open throttle position.

9. A carburetion system in accordance with claim 8 wherein said means for rotating said second throttle shaft comprises a plate including a camming surface, and a roller rotatably connected to said second throttle shaft driven lever and movable by said camming surface.

* * * * *